US009163371B1

(12) United States Patent
Sota

(10) Patent No.: US 9,163,371 B1
(45) Date of Patent: Oct. 20, 2015

(54) SNOW REMOVAL SYSTEM

(71) Applicant: George Sota, West Collingswood, NJ (US)

(72) Inventor: George Sota, West Collingswood, NJ (US)

( * ) Notice: Subject to any disclaimer, the term of this patent is extended or adjusted under 35 U.S.C. 154(b) by 0 days.

(21) Appl. No.: 14/558,073

(22) Filed: Dec. 2, 2014

(51) Int. Cl.
*E01H 5/02* (2006.01)

(52) U.S. Cl.
CPC ..... *E01H 5/02* (2013.01)

(58) Field of Classification Search
CPC ..... E01H 5/02; E01H 5/068; E02F 3/00; E02F 3/02; E02F 3/48; E02F 3/352
USPC ..... 37/269, 272, 342, 394
See application file for complete search history.

(56) References Cited

U.S. PATENT DOCUMENTS

| | | | | | |
|---|---|---|---|---|---|
| 821,660 | A * | 5/1906 | Masten | 37/269 |
| 960,590 | A * | 6/1910 | Skopinski | 37/394 |
| 1,054,410 | A * | 2/1913 | Henness | 172/26.5 |
| 1,686,148 | A * | 10/1928 | Davis | 172/26.6 |
| 1,694,355 | A * | 12/1928 | Royer | 241/301 |
| 1,801,652 | A * | 4/1931 | Alby | 37/427 |
| 1,853,035 | A * | 4/1932 | Briggs et al. | 37/398 |
| 2,119,443 | A * | 5/1938 | Rogers | 37/278 |
| 2,641,372 | A * | 6/1953 | Bjaaland | 414/600 |
| 3,422,974 | A * | 1/1969 | Brubaker | 414/693 |
| 3,643,285 | A * | 2/1972 | Modrey | 15/246.5 |
| 3,893,248 | A * | 7/1975 | Young | 37/268 |
| 4,095,752 | A * | 6/1978 | Pomeret et al. | 414/744.2 |
| 4,731,941 | A * | 3/1988 | Beatty | 37/394 |
| 4,796,367 | A * | 1/1989 | Kulat | 37/273 |
| 4,910,893 | A * | 3/1990 | Asay | 37/281 |
| 5,074,105 | A * | 12/1991 | Roth | 56/8 |
| 5,250,199 | A * | 10/1993 | Haag | 210/803 |
| 5,286,384 | A * | 2/1994 | Haag | 210/527 |
| 5,581,915 | A * | 12/1996 | Lobato | 37/285 |
| 5,974,703 | A * | 11/1999 | Cadarette | 37/269 |
| 6,983,558 | B2 * | 1/2006 | Haas | 37/269 |
| 7,472,009 | B2 * | 12/2008 | Baldwin | 701/50 |
| D656,162 | S * | 3/2012 | Wiik | D15/11 |
| 8,832,973 | B2 * | 9/2014 | Gallacci | 37/265 |
| 8,955,238 | B1 * | 2/2015 | Castruccio | 37/273 |
| 2004/0211095 | A1 * | 10/2004 | Haas | 37/269 |

* cited by examiner

*Primary Examiner* — Jamie L McGowan
(74) *Attorney, Agent, or Firm* — Stuart M. Goldstein

(57) ABSTRACT

A snow removal system utilizes a towing frame having a towing device such as a winch or winch crank. A towing line extends in a straight line path directly from the towing device to a uniquely shaped snow shovel having dual, concave shaped blades. Actuation of the towing device pulls the snow shovel towards the towing frame, causing snow on the ground surface to accumulate on and slide off and to the side of the blades.

9 Claims, 4 Drawing Sheets

SNOW REMOVAL SYSTEM

BACKGROUND OF THE INVENTION

As anyone who has done so can attest, manually shoveling snow off one's driveway or sidewalk is a laborious, even back-breaking task. While there have been many different shovels, tools, and systems which have been proposed to make this job of manual snow removal from sidewalks, driveways, paths, or walkways more efficient and less of an effort, clearing snow, for the most part, remains physically exerting. Other than configuring snow shovel handles, purportedly to assist in alleviating back and leg strain, there has been little advancement in addressing snow removal. There are no tools or systems readily and practically available to the home or building owner which accomplishes the effective removal of snow, without the physical exertion which accompanies the process.

SUMMARY OF THE INVENTION

It is thus the object of the present invention to provide a snow removal system which addresses and overcomes the limitations and disadvantages of existing snow removal and snow clearing techniques.

It is the object of the present invention to provide a snow removal system which efficiently and effectively clears and removes the ground surface of snow.

It is another object of the present invention to provide a snow removal system which eliminates the physical exertion associated with clearing and removal of snow from ground surfaces.

These and other objects are accomplished by the present invention, a snow removal system which utilizes a towing frame having a towing device such as a winch or winch crank. A towing line extends in a straight line path directly from the towing device to a uniquely shaped snow shovel having dual, concave shaped blades. Actuation of the towing device pulls the snow shovel towards the towing frame, causing snow on the ground surface to accumulate on and slide off and to the side of the blades.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
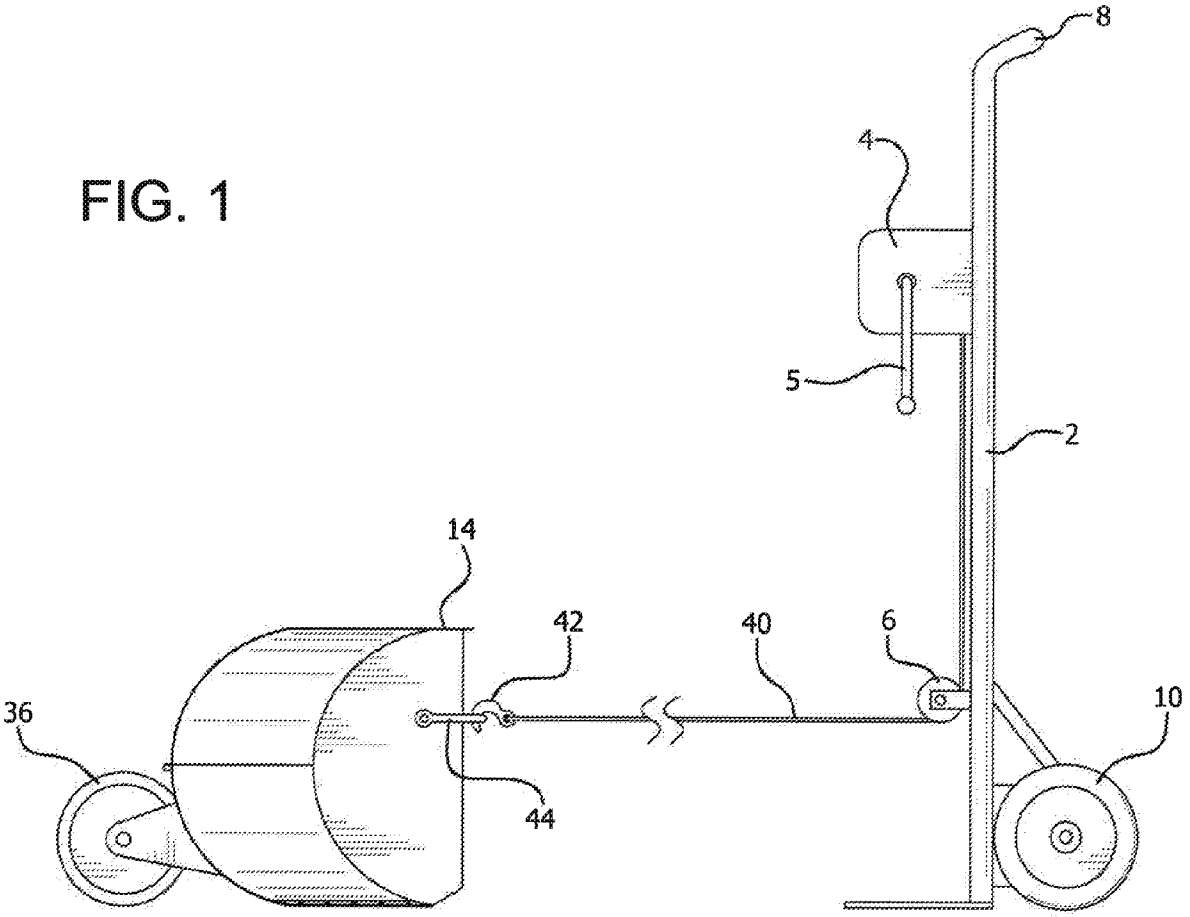
FIG. 1 is an elevation view of the components of the present invention.

The snow removal system of the present invention comprises towing frame 2 to which towing devices, shown as winch 4 and manual handle 5, are connected. Pulley 6 is located below winch 4 and handle 5. Towing frame 2 also comprises upper handle section 8 and lower wheels 10 and 12.

Figure 4:
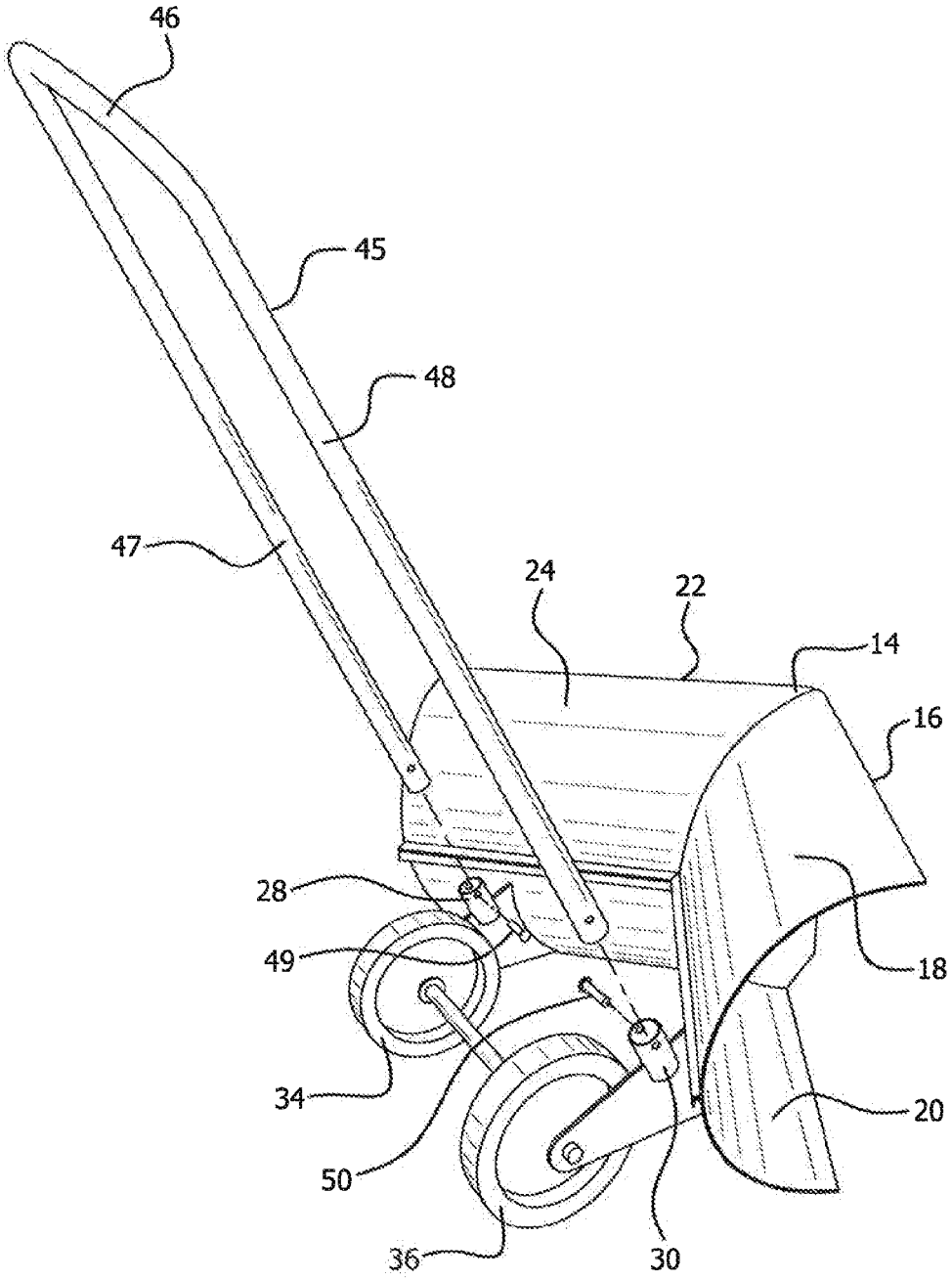
FIG. 4 is a rear view of the shovel components of the present invention.

As best seen in FIG. 4, V-shaped snow shovel 14 has dual, concave shaped blades 16 and 22. Blade 16 has exterior surface 18 and interior surface 20. Blade 22 has exterior surface 24 and interior surface 26. Two cylindrically shaped handle receptacles 28 and 30 are mounted on the back of shovel 14. These receptacles are configured to removeably receive and support snow shovel handle member 32. Wheels 34 and 36 extend from the rear of shovel 14.

Towing line 40 connects towing frame 2 directly to snow shovel 14. The towing line is secured at one end to towing device/winch 4. The line then wraps around pulley 6 and finally extends in a straight line path directly to snow shovel 14, where it is secured, by means of hook 42, to anchor means, e.g. U-shaped anchor 44, attached to and extending from the front of the snow shovel.

Figure 2:
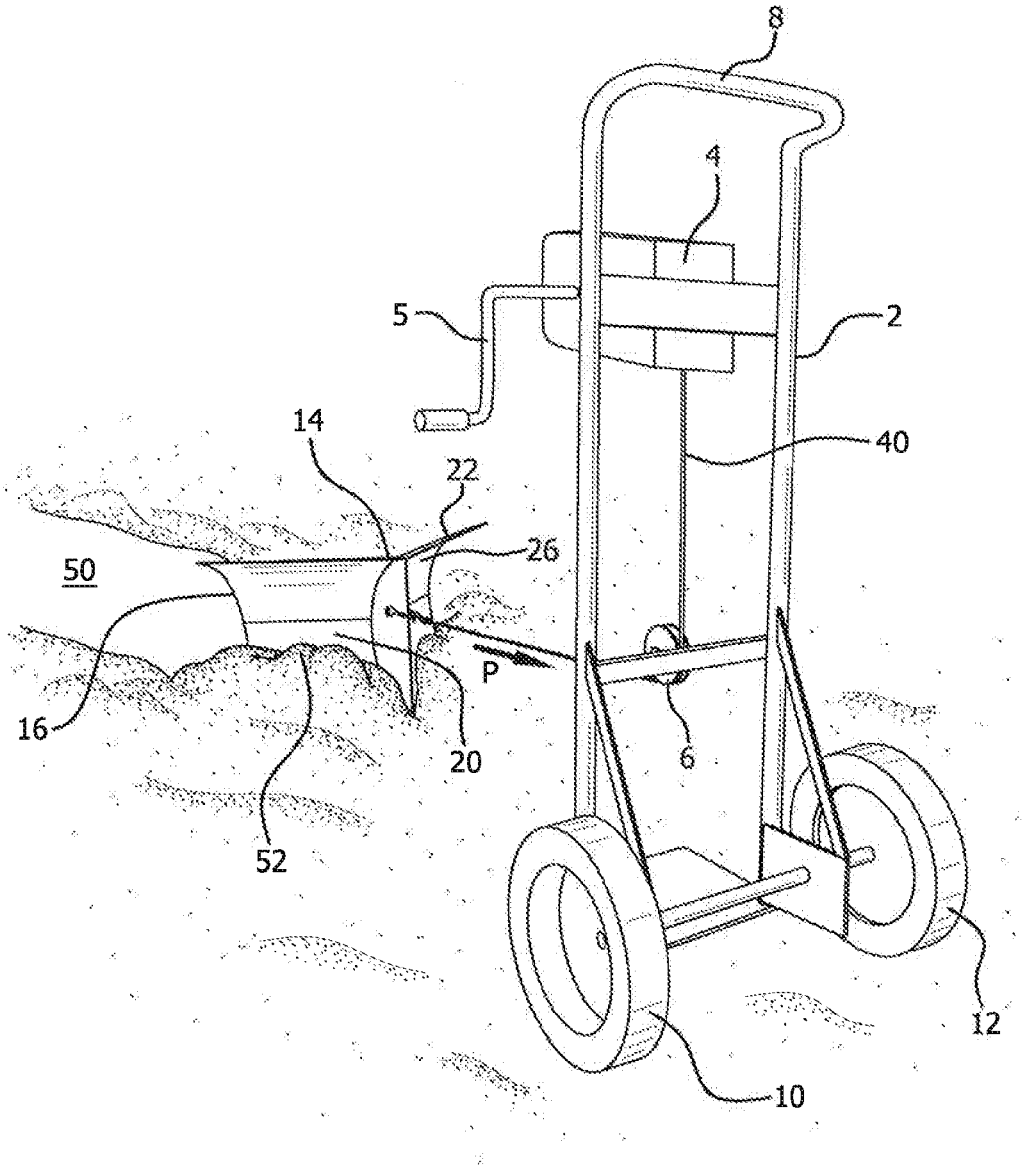
FIG. 2 is a rear isometric view of the present invention depicting its operation.
Figure 3:
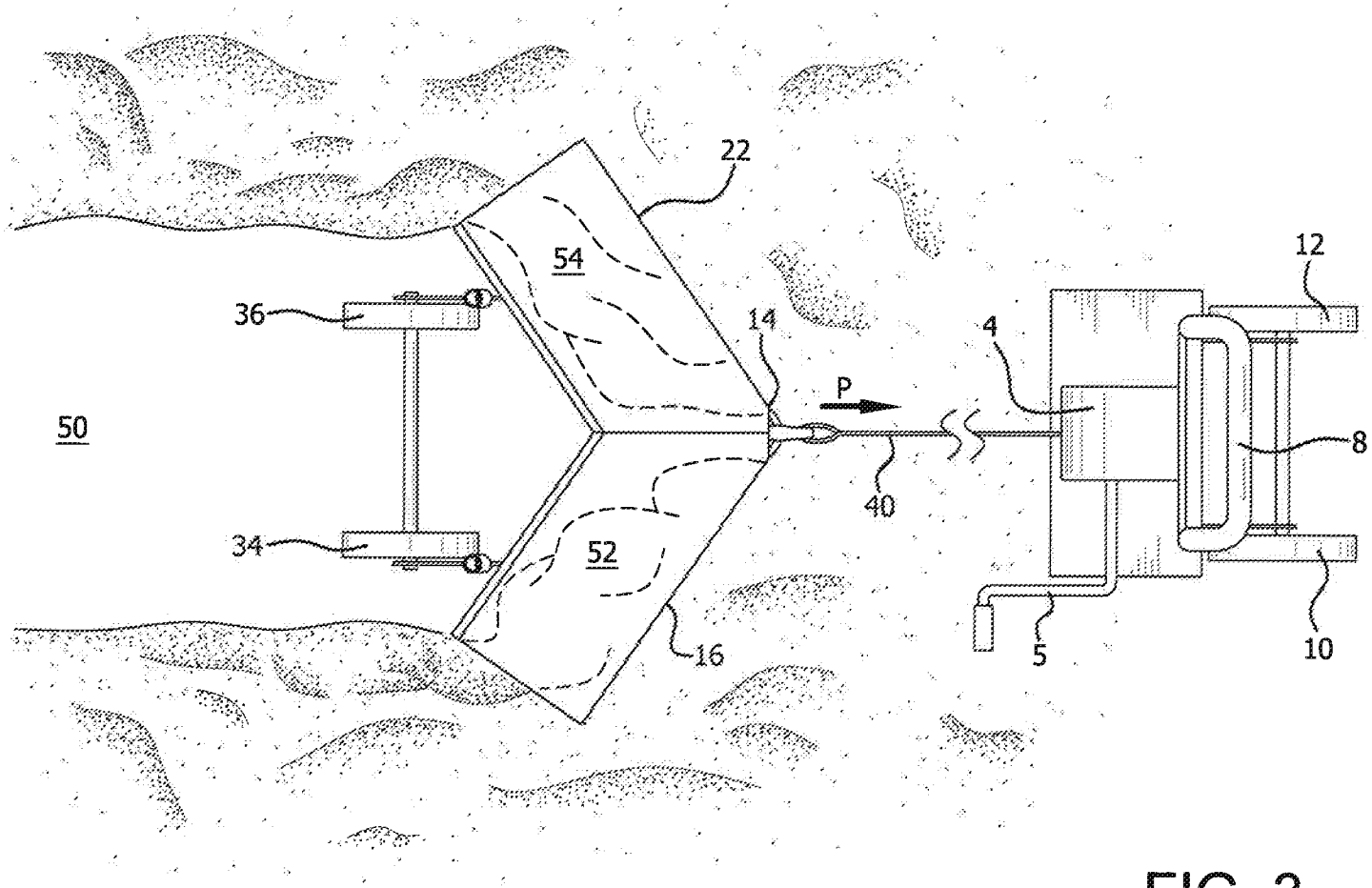
FIG. 3 is a top view of the present invention depicting its operation.

The operation of the snow removal system is as follows, reference in this regard being made to FIGS. 2 and 3.

Snow shovel 14 is positioned on a snowy sidewalk, path, or other walkway or ground surface 50. Towing frame 2 is positioned a distance away from snow shovel 14, for instance a distance from the snow shovel up to 100 feet, depending on the height of the accumulated snow on the ground to be cleared. Towing line 40 is extended outward, in a straight line path, directly from towing frame 2 towards snow shovel 14. Hook 42 secures towing line 40 in this position between towing frame 2 and snow shovel 14.

Winch 4 is then actuated to rotate, such that towing line 40 is pulled P towards towing frame 2, thus also pulling snow shovel 14 toward the towing frame. As snow shovel 14 is moved toward towing frame 2, snow 52 and 54 on ground surface 50 is caused to first accumulate on exterior surfaces 18 and 24 of blades 16 and 22 and then slide off and to the side of the blades, thus clearing the ground of snow behind the snow shovel. When snow shovel 14 reaches towing frame 2, winch 4 is deactuated. This permits towing frame 2 to be manually pulled, via handle section 8, away from snow shovel 14. Towing frame 2 is again positioned a distance from snow shovel 14, with towing line 40 extending in a straight line path directly between the towing frame and the snow shovel. Winch 4 is actuated once again to draw snow shovel 14 towards towing frame 2, to again clear the area in front of the snow shovel of snow. This process continues for the length of the sidewalk or path to be cleared.

Any comparable winch can be used in the system, but it is contemplated that a 2500 hp rated, 12 volt/10 amp winch will be required for the most efficient performance. This winch will operate to tow twelve feet of line in one minute.

While towing device 4 has been described above as a winch, it is contemplated that manual crank 5 could be used to wind towing line 40 around winch type drum 7. Equivalent towing devices e.g. come-a-longs, could also be used to draw towing line 40 towards towing frame 2, to thereby pull snow shovel 14 along the ground.

It is significant that the unique curvation of blades 16 and 22 provides for the most efficient accumulation and sideways movement of snow away from the blades. It is contemplated that each blade will comprise concave exterior surfaces 18 and 24, which are segments of a circle, each one half of a twelve inch diameter tube.

Blades 16 and 22 each have wear strips 17 and 23. These strips are attached by bolts, which can be removed to allow the strips to be replaced when they are worn.

The unique snow shovel 14 of the invention also allows for snow clearing in a snow pushing, rather than pulling mode. This is especially helpful for lesser snow amounts. To set up for the pushing mode, towing line 40 is disconnected from the snow shovel. Auxiliary handle member 45, having top handle section 46 and downwardly extending legs 47 and 48, is provided. Legs 47 and 48 are then inserted into handle receptacles 28 and 30, to allow snow shovel 14 to be utilized in the push mode. Removable connector pins 49 and 50 attach auxiliary handle 45 to handle receptacles 28 and 30. Pins 49 and 50 are removed to allow legs 47 and 48 of auxiliary handle member 45 to be detached and lifted out from receptacles 28 and 30 when it is again desired to reattach towing line 40 and clear the ground with towing frame 2 and towing device 4 in the pulling mode.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A system for the removal of snow from a snow covered ground surface, said system comprising:

a V-shaped snow shovel having dual blades, said shovel having dual receptacles for receiving and supporting a snow shovel handle member for utilizing the snow shovel in a pushing mode, said handle having a top handle section and downwardly extending legs which are inserted into the receptacles;

an independent towing frame, attached to but separable from the snow shovel, the towing frame extending upwardly from and substantially perpendicularly to wheels attached directly to the bottom of the towing frame, the towing frame further comprising an upper handle section located at the top of the towing frame;

a towing device mounted directly on the towing frame for moving the snow shovel along the ground surface in a straight line path, substantially perpendicularly to and directly towards the towing frame; and a towing line extending in a straight, substantially perpendicular line directly between and connecting the towing device located on the towing frame to the snow shovel for utilizing the snow shovel in a pulling mode, whereby in utilizing the snow shovel in the pushing mode, the snow shovel is detached and separated from the towing frame and manually pushed by means of the snow shovel handle member supported within the receptacles, and whereby in utilizing the snow shovel in the pulling mode, the towing device is operated to pull the snow shovel in said straight line path directly towards the towing frame, causing snow on the ground surface to accumulate on and slide off and to the side of the dual blades.

2. The system as in claim 1 wherein said towing device comprises a winch.

3. The system as in claim 2 further comprising a pulley attached to the towing frame, the towing line being secured to the winch, being wrapped around the pulley, and extending directly from the pulley in a straight line to the snow shovel.

4. The system as in claim 1 wherein said towing device comprises a crank extending from a winch drum attached to the towing frame.

5. The system as in claim 1 wherein said dual receptacles are cylindrical elements secured to the snow shovel.

6. The system as in claim 1 wherein said snow shovel comprises anchor means for connecting the towing line to the towing frame.

7. The system as in claim 1 wherein each of the dual blades have concave exterior surfaces.

8. The system as in claim 1 wherein said shovel further comprises wheels.

9. The system as in claim 5 wherein said shovel further comprises wheels.

* * * * *